United States Patent [19]

Krauer

[11] 4,131,183

[45] Dec. 26, 1978

[54] SPEED DICTATION APPARATUS

[75] Inventor: Otto A. Krauer, Tuckahoe, N.Y.

[73] Assignee: Otis Elevator Company, New York, N.Y.

[21] Appl. No.: 131,989

[22] Filed: Apr. 7, 1971

[51] Int. Cl.[2] ..... B66B 1/28

[52] U.S. Cl. ..... 187/29 R

[58] Field of Search ..... 187/29

[56] References Cited

U.S. PATENT DOCUMENTS

| | | | |
|---|---|---|---|
| 3,523,232 | 8/1970 | Hall et al. | 187/29 |
| 3,599,755 | 8/1971 | Lund et al. | 187/29 |
| 3,670,851 | 6/1972 | Shima | 187/29 |

*Primary Examiner*—Robert K. Schaefer
*Assistant Examiner*—W. E. Duncanson, Jr.
*Attorney, Agent, or Firm*—Robert T. Mayer

[57] ABSTRACT

Improved speed dictation apparatus for controlling the speed of an elevator car in which the deceleration of the elevator car is brought into conformity with that which would be provided by a distance controlled signal notwithstanding the continued application of a time controlled signal and the deceleration is made consistent regardless of the length of trip by controlling the speed of the car in accordance with the distance controlled signal before the car starts to decelerate and by controlling the conformity process with a dischargingcapacitive circuit which at the time the conformity process begins is charged to a voltage signifying the difference between the actual speed being dictated to the car and the speed the distance controlled signal is then dictating.

5 Claims, 1 Drawing Figure

Figure 1:
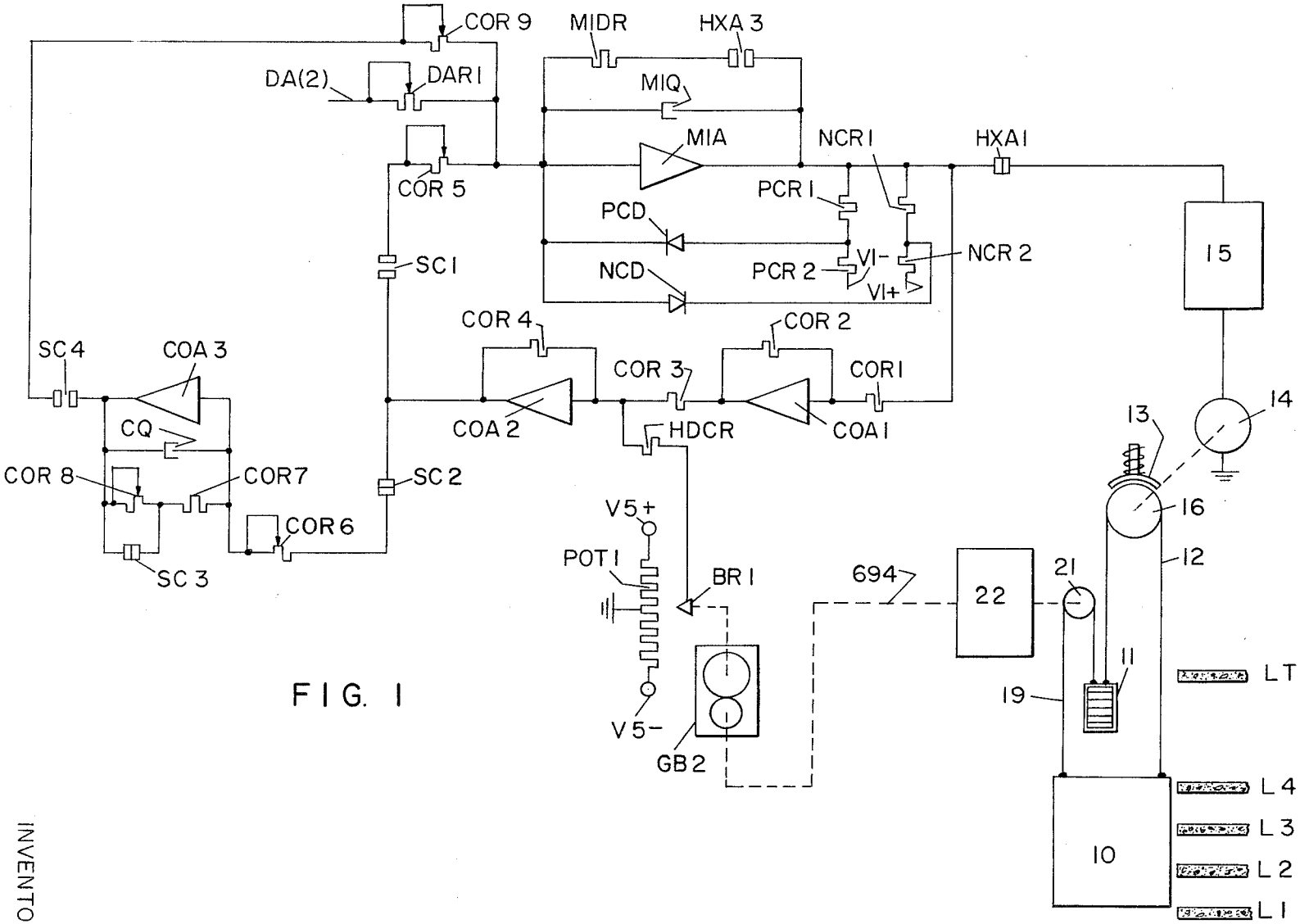

INVENTOR
OTTO ALBERT KRAUER
BY R. T. Mayer ATTORNEY

SPEED DICTATION APPARATUS

This invention relates to elevator controls and more particularly to improved apparatus for controlling the speed of elevator cars.

The invention provides an improved operation over that provided by the apparatus disclosed in U.S. Pat. No. 3,552,524 granted to Sidney Howard Benjamin and Otto Albert Krauer on Jan. 5, 1971. With that apparatus an elevator car is accelerated in response to a time controlled signal until it either reaches its rated running speed or until a signal to stop accelerating is generated. In order for the elevator to complete a trip upon which it attains its rated running speed, it starts to decelerate upon reaching stopping distance from a selected landing. This slow-down initially occurs in response to a time controlled deceleration signal. After a predetermined period, the slow-down operation is caused to begin to conform to that which would be provided by a signal which is operable to decelerate the car as a function of its distance from the selected landing notwithstanding the continued application of the time controlled deceleration signal. Conformity takes place within a suitable period.

In those cases where the car does not attain its rated running speed it is caused to complete its trip in response to the signal to stop accelerating. This signal causes the production of a time controlled signal which causes acceleration to cease and deceleration to begin. Deceleration continues in response to this time controlled signal for the forementioned predetermined period at which time the slow-down operation is caused to begin to conform to that which would be provided by the distance controlled signal in the same manner as on a trip in which the car attains its rated running speed. From this it is obvious that deceleration may not conform to that which would be provided by the distance controlled signal for a considerable distance of travel of the car depending upon the actual speed being dictated to the car by the time controlled signal and that which is dictated by the distance controlled signal at the time that the conformation process begins.

On trips on which the car attains rated running speed and on those on which it comes close to attaining such speed the stopping distances are so large that any distance found to be necessary to attain conformity without discomforting passengers is a relatively short portion of the total required stopping distance; even in extreme cases where, at the time that the process toward conformity begins, the difference between the actual speed being dictated to the car by the time controlled signal and the speed being dictated by the distance controlled signal is considerable. In contrast, on short trips the required stopping distance can be so short that the distance required to produce conformity without discomforting passengers can be a considerable portion of the total required stopping distance, especially under the forementioned extreme circumstances. This may cause the deceleration on short trips to appear to passengers to be inconsistent with that produced on longer trips.

A contributing factor to this seeming inconsistency is the fact that on short trips the process of conformity takes place over a much closer range of distances to the landing at which the car is stopping than on longer trips. Whereas on a short trip the process of conformity may be just beginning at a particular distance from a landing, on a longer trip at the same distance the process of conformity may be long over notwithstanding on both trips the initial difference between the dictated speeds was the same at the beginning of conformity. Thus although the process of conformity may be identical for both trips the deceleration for the short trip over that particular distance to the landing may be different from the deceleration over the same distance for the longer trip.

It is an object of this invention to make the deceleration of an elevator car consistent regardless of the length of the trip.

It is another object of this invention to start to control the speed of an elevator car on a trip in which it will not attain rated running speed in accordance with its distance from a selected landing at which it is to stop before the car starts its deceleration for that trip.

In carrying out the invention there is provided speed dictation apparatus for an elevator car in which the car's acceleration on each trip is controlled by a voltage which varies continuously as a function of time. The deceleration of the car on each trip is controlled by a voltage which varies continuously as a function of the distance the car is from the selected landing at which it is to stop on that trip. On each trip in which the car does not attain its rated running speed the apparatus generates a signal to stop accelerating after the selection of the landing at which the car is to stop and, of course, while the car is still accelerating. The improvement comprises control equipment which, on each trip on which the car does not attain its rated running speed, operates in response to the signal to stop accelerating for that trip and causes the speed dictation apparatus to control the speed of the car in response to the distance controlled voltage before the car starts its deceleration for that trip.

Other objects, features and advantages of the invention will be apparent from the above and from the accompanying drawing when considered in conjunction with the following description and the claims appended hereto.

The single FIGURE of the drawing is a simplified schematic of an elevator control system embodying the invention.

The equipment illustrated in the drawing is similar to that shown in FIG. 1 of the forementioned Benjamin and Krauer patent although some of the elements of the equipment shown in that Figure have been deleted since they are unnecessary to an understanding of the present invention. It is to be understood, however, that these elements, as well as others which are also not necessary to an understanding of the present invention, would be provided in a commercial installation. Reference characters applied to the various elements shown in the drawing are the same as those applied to the corresponding elements shown in FIG. 1 of the Benjamin and Krauer patent.

Referring specifically to the drawing, an elevator car 10 and its counterweight 11 in typical fashion are supported by hoist ropes 12. The car is enabled to move whenever brake 13 is lifted and motor 14 receives power from motor control equipment 15 to rotate sheave 16. Motor control equipment 15 may be any suitable equipment, the equipment mentioned in the foregoing Benjamin and Krauer patent being presently preferred.

Connected between car 10 and counterweight 11 is a tape 19 which is driven over a sprocket 21 as car 10 moves between any of the landings L1 to LT. Sprocket 21 drives the shaft of landing selector mechanism 22. This mechanism may be any one of the several referred to in the foregoing Benjamin and Krauer patent.

Shaft 694 of selector mechanism 22 is connected through gear box GB2 to drive sliding contact, or wiper, BR1 of coarse potentiometer POT1. This potentiometer has its center point grounded and its end terminals connected across voltages designated as V5− and V5+.

Motor control equipment 15 is connected through contacts HXA1 (coil circuit not shown) to the output circuit of speed regulating equipment including a speed determining output voltage generator and voltage control equipment. The speed determining output voltage generator includes operational amplifier MIA arranged as an integrating amplifier having input circuits through resistors DAR1, COR5 and COR9. Condenser MIQ connected in parallel with resetting resistor MIDR through contacts HXA3 together with positive and negative voltage clamping circuits are connected from the input to the output of amplifier MIA. The positive clamping circuit includes diode PCD and resistors PCR1 and PCR2 connected to a voltage source designated V1−. The negative voltage clamping circuit includes diode NCD and resistors NCR1 and NCR2 connected to a positive voltage source V1+.

The voltage control equipment of the speed regulating equipment includes inverting amplifier COA1, its input and output resistors COR1 and COR3 and its scaling resistor COR2. Input resistor COR1 is connected to the output circuit of integrating amplifier MIA. Output resistor COR3 is connected in one of the input circuits to summation amplifier COA2. Connected to the second input circuit to summation amplifier COA2 through resistor HDCR is sliding contact BR1 of potentiometer POT1. The output circuit of amplifier COA2 is connected through contacts SC1 of a stop accelerating switch (coil circuit not shown) to resistor COR5.

Also connected to the output circuit of amplifier COA2 through contacts SC2 of the stop accelerating switch is the input resistor COR6 of integrating amplifier COA3. Condenser CQ together with resistors COR7, COR8 and contacts SC3 are connected from the input to the output of amplifier COA3. This output is also connected through contacts SC4 of the stop accelerating switch to input resistor COR9 of integrating amplifier MIA.

The improved operation over that disclosed in the Benjamin and Krauer patent is provided by the stop accelerating switch whose coil is energized in any suitable manner in response to the generation of a binary 1 signal along line SCC shown in FIGURE 5 of the forementioned patent, and by the integrating amplifier COA3 and its associated condenser CQ and resistors COR6, COR7, COR8 and COR9.

To understand the operation of this improved apparatus reference will be made to its operation during a trip in which the car does not attain its rated running speed. The Benjamin and Krauer patent discloses that throughout the acceleration of the car 10 the output of the speed regulating equipment including operational amplifier MIA is applied to inverting amplifier COA1 so that it can be algebraically summed with the output from the landing selector mechanism applied through sliding contact BR1 of potentiometer POT1. These two signals are applied to summation amplifier COA2 which produces an output equivalent to the difference between the magnitudes of these two signals. In systems employing the Benjamin and Krauer apparatus it is not desirable to employ this output signal until after deceleration has begun.

With the presently disclosed improved apparatus the output signal from amplifier COA2 is applied through contacts SC2 and resistor COR6 to integrating amplifier COA3 not only before deceleration has begun but before the generation of the signal to stop accelerating. As a result, it charges the associated condenser CQ to the magnitude of its difference voltage. The time constant of this charging circuit is maintained at a relatively small value owing to the presence of engaged contacts SC3 in parallel with resistor COR8. When the signal to stop accelerating is produced along line SCC (FIGURE 5 of the Benjamin and Krauer patent) in the manner explained in that patent, the stop accelerating switch operates to open its contacts SC2 and SC3 and to close its contacts SC1 and SC4. As a result, the input to the speed regulating equipment at the instant the signal to stop accelerating is generated comprises the output of the time controlled signal function generator applied along line DA(2), a signal whose magnitude is equal to the difference between the magnitudes of the output of the speed regulating equipment and the landing selector mechanism and a signal exactly opposite in polarity and equal in magnitude to this difference signal. Thereafter condenser CQ discharges through resistors COR7 and COR8 and this discharging voltage by being applied as an input to the speed regulating equipment causes the output of that equipment to seek conformity with the distance controlled signal in a gradual fashion. Throughout this operation the distance controlled signal generated by the landing selector mechanism effectively controls the speed of the car and thus a transfer from control by time to control by distance is produced without any discontinuity in operation.

It is to be noted that at the time the signal to stop accelerating is generated resistor COR8 is inserted in the discharge path of condenser CQ to change the time constant of this circuit. This altered time constant is so chosen as to insure that the output from the speed regulating equipment is in conformity with the distance controlled signal substantially at the instant that the distance controlled signal starts to dictate constant deceleration in the manner described in the foregoing patent.

Although the invention has been specifically described as being applied to the apparatus disclosed in the Benjamin and Krauer patent it is contemplated that it is suitable for application in other type apparatus as well. Thus, it is intended that the embodiment specifically described not be considered to be exclusive or in any sense limiting.

What is claimed is:

1. Speed dictation apparatus for an elevator car comprising a function generator generating a voltage which varies continuously as a function of time and controls the car's acceleration on each trip, a landing selector mechanism generating a voltage which varies continuously as a function of the distance the car is from the selected landing at which it is to stop on each trip, said latter voltage controlling the car's deceleration on each trip, signal generating means operating on each trip in which the car does not attain its rated running speed and generating a signal to stop accelerating in response to the selection of the landing at which the car is to stop, and control equipment connected to said function generator and said landing selector mechanism and receiving both said time controlled voltage and said distance controlled voltage, said control equipment operating in response to said signal to stop accelerating on any trip and causing said distance controlled signal to control the speed of said car from before the car starts its deceleration for that trip by initiating before deceleration starts a gradual transfer from control in which said time controlled voltage predominates to control in which said distance controlled voltage predominates.

2. In speed dictation apparatus according to claim 1, in which said function generator generates the time controlled voltage which controls the acceleration of the car and a time controlled voltage which is operable to decelerate the car and said control equipment includes speed regulating equipment which receives the accelerating and decelerating time controlled voltages and the distance controlled voltage and produces an output voltage which controls the deceleration of the car as the distance controlled voltage would notwithstanding the continued application of said decelerating time controlled voltage by conforming said output voltage to said distance controlled voltage.

3. In speed dictation apparatus according to claim 2, wherein said speed regulating equipment produces a voltage proportional to the difference between said output voltage and said distance controlled voltage which during deceleration said speed regulating equipment algebraically sums with said decelerating time controlled voltage to conform said output signal to said distance controlled signal.

4. In speed dictation apparatus according to claim 3, wherein said control equipment includes a capacitive circuit operating during each trip in which the car does not attain its rated running speed to receive the difference voltage and to store a voltage equal in magnitude and opposite in polarity to said difference voltage until the signal to stop accelerating is generated whereupon the control equipment disconnects said capacitive circuit from the further reception of said difference voltage and connects it to apply its stored voltage to said speed regulating equipment to be algebraically summed with said accelerating time controlled voltage and said difference voltage so that upon the generation of said signal to stop accelerating the input voltages to said speed regulating equipment include the accelerating time controlled voltage, the difference voltage between said output voltage and said distance controlled voltage and a voltage opposite in polarity and equal in magnitude to said difference voltage.

5. In speed dictation apparatus according to claim 4, wherein said capacitive circuit includes an integrating amplifier whose charging time constant is shorter before the generation of a signal to stop accelerating than it is after so that said capacitive circuit charges more rapidly to store said opposite voltage than it discharges in applying its stored voltage to said speed regulating equipment.

* * * * *